US005816311A

United States Patent [19]

Osada et al.

[11] Patent Number: 5,816,311

[45] Date of Patent: Oct. 6, 1998

[54] TWIN ROLL CONTINUOUS CASTER

[75] Inventors: Shiro Osada, Yokohama; Heiji Kato, Yokosuka; Hisahiko Fukase, Meguro-ku; Kengo Ishige, Mitaka, all of Japan; Massoud Assefpour-Dezfully, Brighton, Australia

[73] Assignees: Ishikawajima-Harima Heavy Industries Company Limited, Tokyo, Japan; BHP Steel (JLA) Ltd, Melbourne, Australia

[21] Appl. No.: 968,419

[22] Filed: Nov. 12, 1997

Related U.S. Application Data

[62] Division of Ser. No. 773,633, Dec. 23, 1996, Pat. No. 5,720,335.

[30] Foreign Application Priority Data

Dec. 22, 1995 [AU] Australia ..... PN 7330

[51] Int. Cl.[6] ..... B22D 11/06; B22D 11/124

[52] U.S. Cl. ..... 164/415; 164/417; 164/428; 164/444; 72/38

[58] Field of Search ..... 164/475, 415, 164/417, 476, 480, 428, 444, 486, 413, 455; 72/38, 201

[56] References Cited

U.S. PATENT DOCUMENTS 5,584,337 12/1996 Nakashima et al. ..... 164/476

FOREIGN PATENT DOCUMENTS 57-181749 11/1982 Japan ..... 164/486
62-77151 4/1987 Japan ..... 164/480
3-42101 2/1991 Japan ..... 72/38

*Primary Examiner*—Kuang Y. Lin
*Attorney, Agent, or Firm*—Nikaido, Marmelstein Murray & Oram LLP

[57] ABSTRACT

To suppress generation of scales on surfaces of a strip and to reduce the amount of non-oxidizing gas consumed in the casting of strip in a twin roll caster there is provided downstream apparatus comprising pinch rolls 17*a* and 17*b* for pinching a strip 4 continuously cast by a pair of casting rolls 1*a* and 1*b*, a coiler 8 for coiling the strip 4 delivered from the pinch rolls 17*a* and 17*b*, an upstream chamber 19 for enclosing a travelling path of the strip 4 from the casting rolls 1*a* and 1*b* to the pinch rolls 17*a* and 17*b*, a downstream chamber 24 for enclosing a travelling path of the strip 4 from the pinch rolls 17*a* and 17*b* to a position before the coiler, a shutter on an end of the downstream chamber closer to the coiler and a gas supply source for supplying non-oxidizing and reducing gases to the upstream and downstream chambers 19 and 24 and quenching means within the downstream chamber to cool the strip so that it leaves the chamber at a temperature of 300° C. or below.

15 Claims, 4 Drawing Sheets

TWIN ROLL CONTINUOUS CASTER

This is a division of application Ser. No. 08/773,633 filed Dec. 23, 1996, now U.S. Pat. No. 5,720,335.

TECHNICAL FIELD

The present invention relates to continuous casting of metal strip in a strip caster, and more particularly but not exclusively to a twin roll continuous caster.

Various twin roll continuous casters have been proposed as means for continuously casting metal strip from molten metal.

FIG. 4 illustrates a strip caster or twin roll continuous caster as disclosed in JP-A-63-26240 and JP-A-63-30158.

Reference numerals 1*a* and 1*b* denote a pair of internally cooled casting rolls which are horizontally arranged in parallel with each other.

Arranged immediately above the rolls 1*a* and 1*b* is a tundish 3 for providing a molten metal pool 2 between the rolls 1*a* and 1*b*. With the pool 2 formed between the rolls 1*a* and 1*b*, the rolls 1*a* and 1*b* on the left and the right in FIG. 4 are concurrently rotated clockwise and counterclockwise, respectively, so that metal solidifies between the rolls 1*a* and 1*b* into a strip 4 with thickness corresponding to a roll gap of the rolls 1*a* and 1*b* and is continuously delivered downward of the rolls 1*a* and 1*b*.

Reference numerals 5*a* and 5*b* denote paired groups of pinch rolls which are immediately below the rolls 1*a* and 1*b* to pinch the strip 4, which is delivered downward of the rolls 1*a* and 1*b*, in the direction of thickness of the strip.

Reference numeral 6 denotes a strip guide member which is in the form of a curved plate in side view. The guide member 6 is arranged below the pinch roll groups 5*a* and 5*b* to horizontally guide the strip 4 delivered downward from the roll groups 5*a* and 5*b*.

Reference numerals 7*a* and 7*b* denote a pair of pinch rolls which are arranged ahead of the guide member 6 in the direction of travel of the strip to pinch the strip 4, guided horizontally by the guide members 6, in the direction of thickness of the strip.

Reference numeral 8 denotes a coiler which is arranged downstream of the pinch rolls 7*a* and 7*b* in the direction of travel of the strip to coil the strip 4 delivered horizontally from the pinch rolls 7*a* and 7*b*.

Lower halves of the above-mentioned casting rolls 1*a* and 1*b* as well as the pinch roll groups 5*a* and 5*b*, the guide member 6, the pinch rolls 7*a* and 7*b* and the coiler 8 are accommodated in an integrally formed chamber or casing 9. In the chamber 9, nozzles 10*a* and 10*b* are arranged to respectively face lower and upper surfaces of the strip 4 between the guide member 6 and the pinch rolls 7*a* and 7*b*.

The nozzles 10*a* and 10*b* are connected to a gas supply source 12 via supply pipes 11*a* and 11*b*, respectively. Connected to the chamber 9 is a further gas supply 14 via further supply pipes 13*a* and 13*b*.

More specifically, in the twin roll continuous caster as shown in FIG. 4, non-oxidising gas, such as nitrogen, is supplied to the chamber 9 to establish a non-oxidising gas atmosphere in the chamber 9. Further, injection of the nitrogen gas through the nozzles 10*a* and 10*b* suppresses generation of scales or oxide films on the surfaces of the strip 4.

The strip 4, which has temperature as high as about 1400° C. when delivered from the rolls 1*a* and 1*b*, is cooled down into about 600° to 800° C. by the nitrogen gas injected through the nozzles 10*a* and 10*b*.

However, in the conventional twin roll continuous caster as shown in FIG. 4, a completely non-oxidising gas atmosphere inside the chamber 9 is difficult to maintain. Moreover, the amount of nitrogen gas consumed is very high since the chamber 9 is opened to the atmospheric air when the strip 4 having been coiled by the coiler 8 is taken out of the chamber 9. Additionally, the cost of nitrogen is high and hence the cost of operation is high.

WO 95-26840 proposed a twin roll caster having a chamber to enclose the strip issuing from the caster from its formation at the pool to an in line rolling mill wherein the cast strip is cooled within the chamber with water. However, the inventors have found that quenching in a chamber which encloses the strip from its formation at the casting pool can present a number of difficulties, not the least of which is the problem of condensation. This problem is exacerbated and becomes particularly critical when casting ferrous metals such as steel and when quenching is effected by a quenching medium which is generally liquid at room temperature, and more particularly when it is proposed to use an inexpensive quenching medium such as water. When casting steel strip in a twin roll caster, the strip leaves the nip at very high temperatures of the order of 1400° C., hence it is believed that the application of quenching medium of this kind in such a chamber can cause vaporisation and subsequent condensation. It has been found that condensation on the casting rolls can cause explosions in the casting pool, with consequential deleterious effects on the casting process and on the quality of any strip that may issue. This is particularly an issue during start up when the casting rolls are at their coldest.

Japanese patent publication no. 199152 of 1984 (59-19912) proposes placing the casting rolls of a twin roll caster and three cooling rolls for cooling the cast slab after it has emerged from the casting rolls entirely within a chamber which is filled with an inert gas, and withdrawing the cast slab from the chamber once the temperature of the cast slab has fallen to not more than 150° C. Under this method, the cast slab (having a thickness of 4 mm) is not permitted to come into contact with air until the temperature of the cast slab has fallen to 150° C., and hence it is possible to substantially prevent the formation of the oxide scale on the cast slab 6.

However, the method revealed by Japanese patent no. 199152 of 1984 suffers the deficiencies or disadvantages that, with a large-scale twin roll type continuous casting machine, the chamber that is filled with inert gas is very large, the cost of the equipment is high, and large amounts of inert gas are required, and hence the cost of operation is high. Not only are the cooling rolls expensive, but also they need to be vertically displaced to guide or thread the strip therethrough. Additionally the leading end of the slab can prove difficult to thread and a large portion of the leading end cannot be properly cooled during the threading stage and hence is of poor quality and must be discarded.

Japanese patent publication no. 339752 of 1994 (06-339752) proposes a twin roll caster having an atmosphere adjustment zone below the casting rolls and adjoining the casting rolls in the direction of travel of the cast slab or strip having, for example, a thickness of 3 mm, wherein the atmosphere adjustment zone is formed of a plurality of atmosphere adjustment chambers, the atmosphere of each adjacent atmosphere adjustment chamber sequentially cooling the cast strip travelling therethrough so that a strip having a surface temperature of not less than 500° C. issues from the ultimate chamber. Each chamber is provided with a non-oxidising atmosphere containing not more than 0.5 vol % of oxygen.

Additionally it describes experiments in which the cast strip is cooled in various atmospheres of controlled composition to exit at various temperatures from the adjacent chambers. The experiments demonstrate that cooling the strip to 380° C. in an argon atmosphere (with an oxygen <0.5 vol %) provides an oxide thickness of 3 microns, whereas cooling to 520° C. in the same atmosphere followed by cooling in an air atmosphere to 380° C. provides an oxide thickness of 5 microns. Further substituting nitrogen for argon in the latter experiment provides an oxide thickness of 4 microns. Additionally, it discloses that the use of an argon atmosphere containing 0.1 to 1 volt oxygen to cool the strip down to 380° C. produces 23 microns scale.

WO publication no. 95/26242 proposes a twin roll caster having a plurality of atmosphere adjustment chambers of the kind proposed in J06-339752. The strip passing through the various chambers is cooled at the same cooling rates as in J06-339752 but the inert atmosphere within the chambers contains much higher levels of oxygen (up to 5.0 vol %) and the temperature at which the strip issues for the ultimate chamber is above 750° C. The strip is said to issue with a scale thickness in the range of 6 to 10 microns.

Scale or oxide film thicknesses of this order are unacceptable for cold rolling and subsequent metal coating. Hitherto, the oxide films have been removed or the thickness thereof has been reduced to acceptable levels (no more than 0.1 microns) by pickling.

The present invention addresses this problem by providing a method of strip casting and strip casting apparatus that provides strip having an oxide film thickness of up to 0.5 microns so that the strip can be cold rolled without pickling and then metal coated, i.e. coated with zinc, zinc alloys, aluminium or aluminium alloys or the like.

Surprisingly it has been found that oxide layers up to 0.5 microns can be tolerated, with such oxide being reduced in the pre-coating furnaces that traditionally remove oil left from cold rolling. Such reductions being achieved without heating the strip to temperatures at which full recrystallisation occurs.

An object of the present invention is to substantially overcome or alleviate one or more of the above identified problems or disadvantages of the prior art.

DISCLOSURE OF THE INVENTION

Accordingly the invention provides a method of continuously casting metal strip comprising:

supporting a casting pool of molten metal on one or more chilled casting surfaces;

moving the chilled casting surface or surfaces to produce a solidified strip moving away from the casting pool; and guiding the solidified strip along a travelling path which takes it away from the casting pool towards a coiler;

confining the strip throughout said travelling path within an enclosure comprising an upstream chamber adapted to enclose the strip from its formation at the casting pool and one or more other chambers, each chamber providing a controlled atmosphere whereby to control the formation of scale on the strip as it passes through said travelling path;

quenching the strip within one of the one or more other chambers such that the strip leaves the travelling path at a temperature of no more than 300° C., whereby the scale on the strip is no more than 0.5 microns thick; and passing the strip to a coiler.

Preferably, the method comprises the further steps of uncoiling the strip and cold rolling the strip without pickling.

More preferably, the supporting step comprises supporting the casting pool on a pair of chilled casting rolls forming a nip between them, and the moving step comprises rotating the rolls in mutually opposite directions to produce the solidified strip such that it moves downwardly from the nip.

It is preferred that the step of quenching is effected by means of a quenching medium which is generally liquid at room temperature.

More preferably, the quenching medium is any one of methyl alcohol, water, and a mixture of methyl alcohol and water.

The method may further comprise the further step of feeding solidified strip to a hot rolling mill disposed along the travelling path so that the strip is hot rolled in line with the strip caster.

The temperature of the strip may be adjusted before it enters the rolling mill by heating means disposed ahead of the rolling mill.

The strip remains within the enclosure at its entry into the rolling mill. This may be achieved by enclosing the rolling mill within the enclosure or more preferably, sealing the enclosure against rolls of the rolling mill.

The enclosure may comprise seal means in the form of a pair of pinch rolls between which the strip passes to exit the enclosure. More preferably, the enclosure comprises seal means in the form of a shutter through which the strip passes to exit the enclosure.

The method may comprise the further step of purging the enclosure before commencement of casting of said strip so as to reduce the initial oxygen level within the enclosure to no more than 5 vol %.

It is preferred that the method includes the further steps of collecting and processing waste quenching medium for recycling as quenching medium.

The enclosure may completely enclose the casting pool.

Preferably, the method comprises the further step of supplying non-oxidising gas to at least one of the plurality of chambers.

More preferably, the method comprises the further step of supplying reducing gas to at least one of the plurality of chambers.

It is preferred that the enclosure comprises the upstream chamber and two other chambers being an intermediate chamber and a downstream chamber to define the travelling path, and that the method includes the steps of: pinching the strip issuing from the caster by means of pinch rolls; rolling the strip delivered from said pinch rolls by means of a rolling mill having work rolls; sealing the upstream chamber which encloses the travelling path between the casting rolls and the pinch rolls by means of seal members contacting outer peripheries of the casting rolls and pinch rolls; sealing the intermediate chamber which encloses the travelling path between the pinch rolls and the work rolls by means of seal members contacting outer peripheries of the pinch and work rolls; sealing the downstream chamber which encloses the travelling path between the work rolls to a position ahead of the coiler by means of seal members contacting outer peripheries of the work rolls and sealing means adapted to pass the strip at the downstream end of the downstream chamber.

The invention also provides an apparatus for casting metal strip comprising:

a pair of generally horizontal casting rolls forming a nip between them;

metal delivery means to deliver molten metal into the nip between the casting rolls to form a casting pool of molten metal supported on the rolls;

means to chill the casting rolls;

means to rotate the casting rolls in mutually opposite directions whereby to produce a cast strip delivered downwardly from the nip;

strip guide means to guide the strip delivered downwardly from the nip through a travelling path which takes it away from the nip towards a coiler;

a hot rolling mill disposed along said travelling path to receive the cast strip and to roll that strip in line with the strip caster; and an enclosure to confine the strip throughout said travelling path which enclosure comprises an upstream chamber adapted to enclose the strip from its formation at the nip and one or more other chambers, each chamber having a controlled atmosphere whereby to control the formation of scale on the strip during operation of the apparatus wherein at least one of the one or more other chambers is provided with quenching means comprising a quenching medium which is liquid at room temperature to quench the strip passing therethrough so that the strip issues from the travelling path a temperature of no more than 300° C.

The quenching medium may, for example, comprise any one of method alcohol, water or a mixture of methyl alcohol and water.

Preferably, seal members are provided in the form of labyrinth seals to form seals between said chambers.

Preferably, the rolling mill is disposed between chambers.

More preferably, the apparatus further comprises heating means disposed ahead of the rolling mill to adjust the temperature of the strip before it enters the rolling mill.

According to a first embodiment there is provided apparatus for casting metal strip by a method of the present invention comprising a twin roll continuous caster, pinch rolls for pinching a strip continuously cast by a pair of casting rolls of the caster, a coiler for coiling the strip delivered from the pinch rolls, an upstream chamber for enclosing a travelling path of the strip from the casting rolls to the pinch rolls, said upstream chamber having seal members for airtightly contacting outer peripheries of the casting and pinch rolls, a downstream chamber for enclosing a transit path of the strip from the pinch rolls to a position before the coiler, said downstream chamber having seal members for airtightly contacting outer peripheries of the pinch rolls and seal means on an end of the downstream chamber closer to the coiler adapted to pass the strip therethrough, a gas supply source for supplying non-oxidising and reducing gases to the upstream and downstream chambers and quenching means comprising a quenching medium which is liquid at room temperature for quenching the strip in the downstream chamber, such that the strip leaves the chamber at no more than 300° C. and whereby the strip is coiled and has no more than 0.5 microns thick scale thereon such that it can be subsequently cold rolled without pickling.

According to a second embodiment, the invention provides strip casting apparatus comprising a twin roll continuous caster, pinch rolls for pinching a strip continuously cast by a pair of casting rolls of the caster, a rolling mill with a pair of work rolls for rolling the strip delivered from said pinch rolls, a coiler for coiling the strip delivered from the rolling mill, an upstream chamber for enclosing a travelling path of the strip from the casting rolls to the pinch rolls, said upstream chamber having seal members for airtightly contacting outer peripheries of the casting and pinch rolls, an intermediate chamber for enclosing a travelling path of the strip from the pinch rolls to the work rolls, said intermediate chamber having seal members for airtightly contacting outer peripheries of the pinch and work rolls, a downstream chamber for enclosing a travelling path of the strip from the work rolls to a position before the coiler, said downstream chamber having seal members for airtightly contacting outer peripheries of the work rolls and seal means on an end of the downstream chamber closer to the coiler adapted to pass the strip therethrough, a gas supply source for supplying non-oxidising and reducing gases to the upstream, intermediate and downstream chambers and quenching means comprising a quenching medium which is liquid at room temperature for quenching the strip in the downstream chamber, such that the strip leaves the chamber at no more than 300° C. and whereby the strip is coiled and has no more than 0.5 microns thick of scale thereon such that it can be subsequently cold rolled without pickling.

Preferably, nozzle groups are arranged in each of the chambers to face the strip, said nozzle groups being connected to a gas supply source.

In embodiments having a rolling mill heaters may be arranged between the pinch rolls and work rolls of the mill to face the strip so that the temperatures of the strip may be adjusted before it enters the rolling mill.

Preferably, the quenching means further comprises the nozzle groups in the downstream chamber and a quenching medium supply source for supplying quenching medium thereto.

Preferably the apparatus further comprises means for collecting and means for processing waste quenching medium for recycling as quenching medium.

It is preferred that non-oxidising and reducing gases are supplied into the chambers, thereby suppressing generation of scale on the surfaces of the strip.

In embodiments provided with a rolling mill, the rolling mill may be arranged between the pinch rolls and the coiler.

Preferably, the seal means is in the form of a shutter.

BRIEF DESCRIPTION OF THE DRAWINGS

In order that the invention may be more fully explained preferred embodiments of the present invention will be described with reference to the accompanying drawings in which.

BEST METHOD OF CARRYING OUT THE INVENTION

Figure 1:
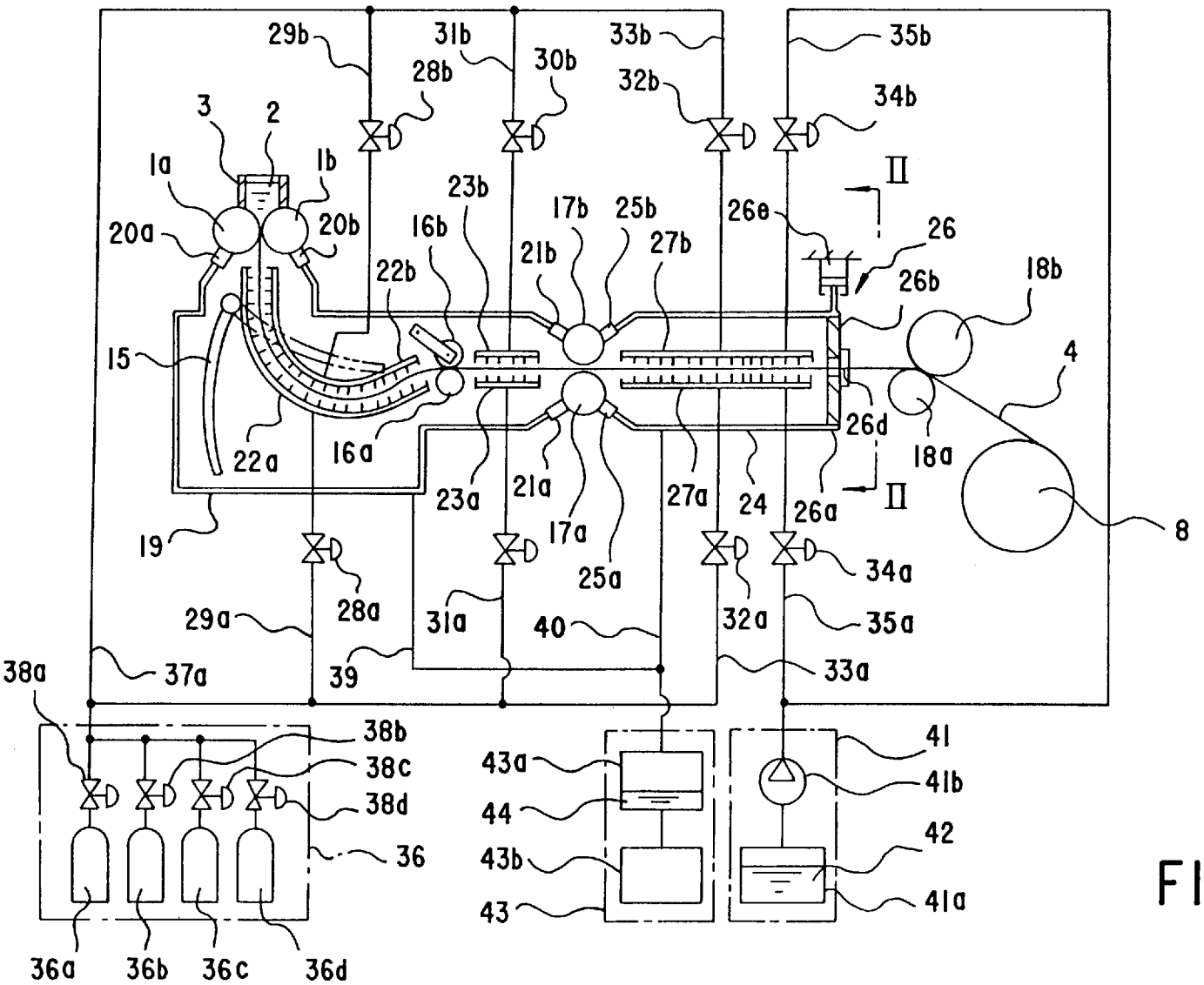
FIG. 1 is a schematic view of a first embodiment of a twin roll continuous caster for casting metal strip by a method according to the present invention.

Experimental apparatus for determining the level of strip oxidation under conditions simulating those in a twin roll strip caster incorporating controlled atmosphere cooling together with gas and water quenching in accordance with the present invention comprised an infra-red furnace, an upper cooling chamber and a pneumatically operated retractable specimen holder. Nitrogen gas entered the furnace at its base and was vented through the upper chamber, while maintaining a positive pressure in both the furnace tube and the cooling chamber. The upper chamber contains two diametrically opposed gas spray nozzles and two water spray nozzles also diametrically opposed to each other, but at right angles to the gas nozzles. The gas nozzles are hollow brass blocks with a front plate measuring 55×30 mm and containing 94 holes, 0.5 mm in diameter, spaced at 4.75 mm, delivering the gas to the specimen surface 35 mm away. The water nozzles are full cone type covering an area of approximately 60 mm in diameter from a spray distance of 50 mm. A PLC controlled pneumatic ram was used to lower the specimen into the furnace and retract it to the upper chamber at high speeds. A hand operated partition isolated the furnace from the upper chamber during water spray tests. An R-type thermocouple, welded to the centre of the specimen and a secured with a screw, controlled the furnace and monitored the specimen temperature throughout the test; the data was logged into a PC. The maximum heating temperature was approximately 1400° C.

The steel strip specimens used in these tests were FK08 steel (0.08% C, 0.4% Mn, 0.18% Si, 0.007% Al) of dimensions 127×32×2 mm, with an as-ground surface finish. In a typical test, nitrogen was first purged through the system for about 10 minutes to avoid oxidation of the specimen during heating, after which the pneumatic arm lowered the specimen into the infra-red furnace where it was heated to 1325° C. in the nitrogen atmosphere and held for approximately 1 minute. The specimen was then retracted by the pneumatic cylinder to the upper chamber where it was either allowed to cool naturally in nitrogen or force cooled with either nitrogen jets or water sprays, or a combination of both. The nitrogen gas used was a high purity grade rated at 99.99% and was specified to contain <12 ppm oxygen, <10 ppm water vapour and <2 ppm hydrocarbons.

Details of the tests are as follows.

TEST 1

The specimen was heated in the nitrogen purged furnace to 1325° C., retracted from the furnace and allowed to be naturally cooled in air to room temperature. The upper cooling chamber was removed before commencing the test. The calculated scale thickness from mass gain determination was 32 microns.

TEST 2

The specimen was heated in the furnace to 1325° C. in $N_2$ and retracted into the upper chamber being purged with $N_2$ and hit with $N_2$ gas at 200 KPa flowing at 114 1/min, cooled to room temperature. The calculated scale thickness was 0.25 microns.

TEST 3

The specimen was heated in the furnace to 1325° C. in $N_2$ and retracted into the upper chamber being purged with $N_2$, sprayed at 1030° C. with tap water at 300 to 400 KPa to room temperature. The calculated scale thickness was 0.3 microns.

TEST 4

The specimen was heated in the furnace to 1325° C. in $N_2$ and retracted into the upper chamber being purged with $N_2$, sprayed at 1150° C. with pressurised water at 400 KPa to room temperature. The calculated scale thickness was estimated at not more than 0.5 microns.

It was expected that water spraying in a nitrogen atmosphere would lead to unacceptable levels of oxidation as water contains dissolved oxygen and the breakdown of water (steam) to oxygen and hydrogen will provide further oxidation, however it was surprisingly and unexpectedly found that it is possible to limit the thickness of oxide on the strip to no more than 0.5 microns. Additionally, it has surprisingly been found these levels of oxide are tolerable for cold rolling without picking and then metal coating the strip.

Figure 2:
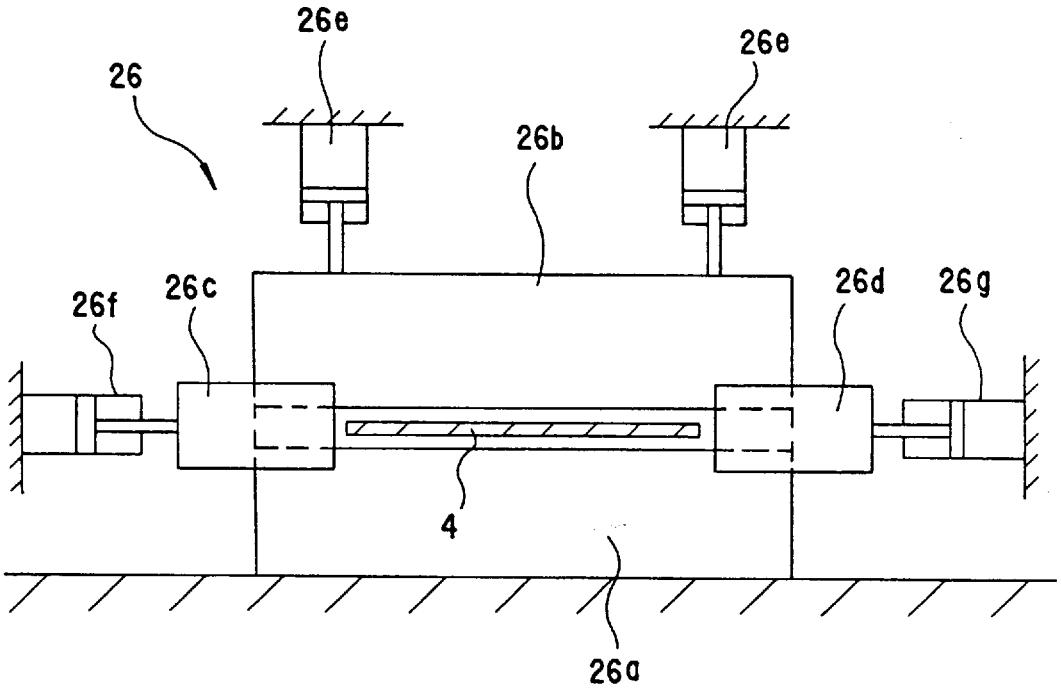
FIG. 2 is a schematic view of a shutter in the twin roll continuous caster shown in FIG. 1.
Figure 4:
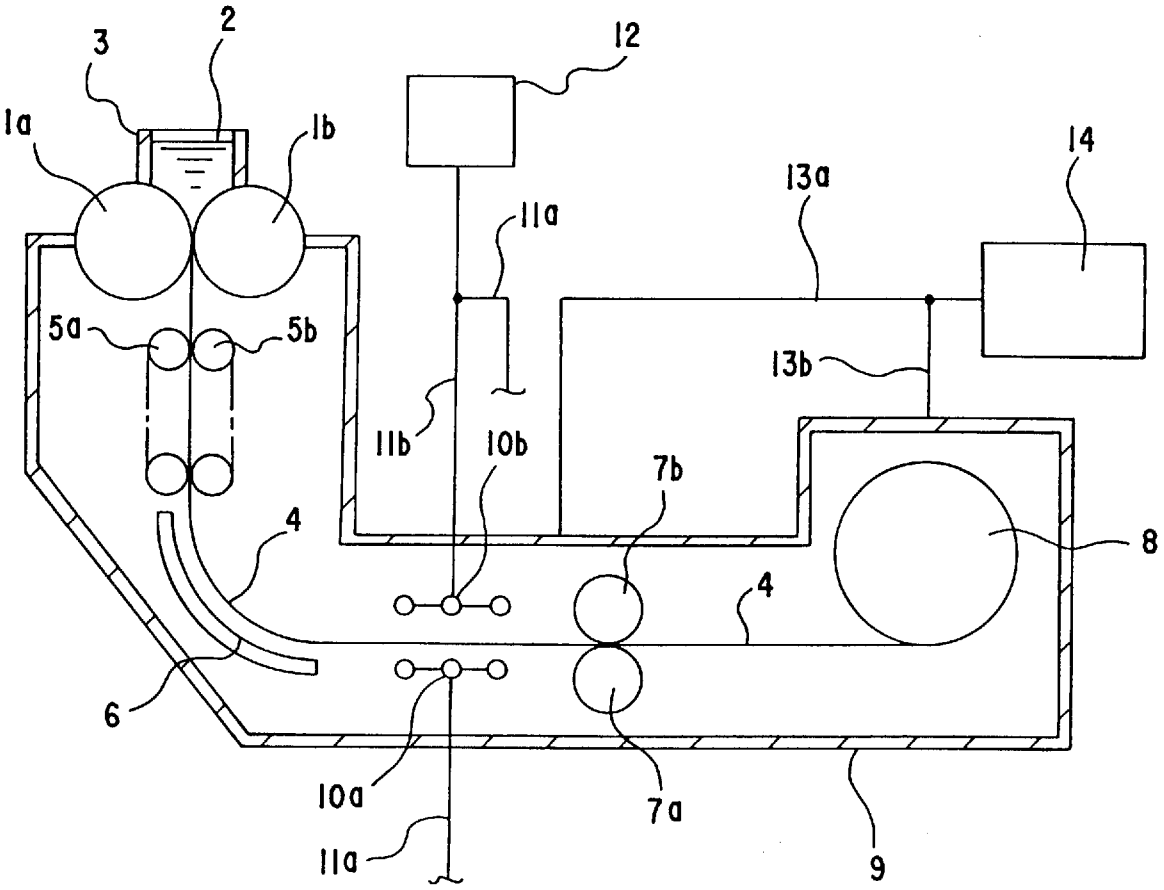
FIG.4 PRIOR ART
FIG. 4 is a schematic view of a conventional twin roll continuous caster.

FIGS. 1 and 2 illustrate a first embodiment of the twin roll continuous caster for casting metal strip by a method according to the present invention in which the same components as in FIG. 4 are referred to by the same reference numerals.

Reference numeral 15 denotes a sledding table in the form of a curved plate in side view of the system. The table 15 is arranged immediately below a pair of cooled casting rolls 1*a* and 1*b* such that it can be pivoted between a guiding position shown by two-dot chain line in FIG. 1 for horizontally guiding a strip 4 delivered downward from the paired rolls 1*a* and 1*b* and an inoperative position shown by solid line in FIG. 1 down away from the guiding position.

Reference numerals 16*a* and 16*b* denote a pair of catch rolls which are arranged ahead of the table 15 in the direction of travel of the strip to pinch the strip 4, horizontally guided by the table 15 positioned in its guiding position, in the direction of thickness of the strip. The catch roll 16*b* above the strip 4 may be vertically moved toward and away from the catch roll 16*a* below the strip 4.

Reference numerals 17*a* and 17*b* denote a pair of first pinch rolls which are arranged ahead of the catch rolls 16*a* and 16*b* in the direction of travel of the strip to pinch the strip 4 from the rolls 16*a* and 16*b* in the direction of thickness of the strip.

Reference numerals 18*a* and 18*b* denote a pair of second pinch rolls which are arranged ahead of the first pinch rolls 17*a* and 17*b* in the direction of travel of the strip to pinch the strip 4 from the rolls 17*a* and 17*b* in the direction of thickness of the strip. A coiler 8 for coiling the strip 4 is arranged ahead of the second pinch rolls 18*a* and 18*b* in the direction of travel of the strip.

Reference numeral 19 denotes an upstream chamber which is 8 designed to enclose the travelling path of the strip 4 from the casting rolls 1*a* and 1*b* to the first pinch rolls 17*a* and 17*b*. The table 15 and the catch rolls 16*a* and 16*b* as described above are arranged in the upstream chamber 19.

Connected to a bottom of the upstream chamber 19 is an upstream end of a discharge pipe 39 in the direction of passage of fluid.

Reference numerals 20*a* and 20*b* denote seal members which are fixed to an end of the upstream chamber 19 facing to the casting rolls 1*a* and 1*b* so as to airtightly contact outer peripheries of the rolls 1*a* and 1*b*.

Reference numerals 21*a* and 21*b* denote seal members which are fixed to the other end of the upstream chamber 19 facing to the first pinch rolls 17*a* and 17*b* so as to airtightly contact outer peripheries of the rolls 17*a* and 17*b*.

These seal members 20*a*, 20*b*, 21*a* and 21*b* may be labyrinth seals or wire seals made of numerous metal wires.

Reference numerals 22*a* and 22*b* denote nozzle groups which are arranged in the upstream chamber 19 and between a position immediately below the casting rolls 1*a* and 1*b* and the catch rolls 16*a* and 16*b* such that they can be displaced in the direction of width of the strip 4 between an operative position facing to one and the other (lower and upper) surfaces of the strip, respectively, and an inoperative position laterally of the strip 4. While the nozzle groups 22*a* and 22*b* are in their inoperative positions, the sledding table 15 can be pivoted between its inoperative position and its guiding position.

Connected to the nozzle groups 22*a* and 22*b* are downstream ends, in the direction of passage of fluid, of supply pipes 29*a* and 29*b* having flow control valves 28*a* and 28*b*, respectively.

Reference numerals 23*a* and 23*b* denote nozzle groups which are arranged in the upstream chamber 19 and between the catch rolls 16*a* and 16*b* and the first pinch rolls 17*a* and 17*b* so as to face the lower and upper surfaces of the strip 4, respectively.

Connected to the nozzle groups 23*a* and 23*b* are downstream ends, in the direction of passage of fluid, of supply pipes 31*a* and 31*b* having flow control valves 30*a* and 30*b*, respectively.

Reference numeral 24 denotes a downstream chamber which is designed to enclose the travelling path of the strip from the first pinch rolls 17*a* and 17*b* to a position before the second pinch rolls 18*a* and 18*b*.

The downstream chamber 24 is provided with a non-contact type temperature sensor means (not shown) such as radiation thermometer for sensing temperature of the strip 4 by converging and converting infrared energy emitted from the surfaces of the strip 4 into electric signal.

Connected to a bottom of the downstream chamber 24 is an upstream end, in the direction of passage of fluid, of a discharge pipe 40.

Reference numerals 25*a* and 25*b* denote seal members which are fixed to an end of the downstream chamber 24 facing to the first pinch rolls 17*a* and 17*b* so as to airtightly contact the outer peripheries of the first pinch rolls 17*a* and 17*b*.

The seal members 25*a* and 25*b* may be labyrinth seals or wire seals made of numerous metal wires.

Reference numeral 26 denotes seal means in the form of a shutter which is arranged on an end of the downstream chamber 24 facing to the second pinch rolls 18*a* and 18*b* and is adapted to pass the strip 4.

The shutter 26 comprises a lower cover 26*a* fixed to the end of the downstream chamber 24 facing to the second pinch rolls 18*a* and 18*b* so as to be positioned below the strip 4, a vertically movable upper cover 26*b* positioned above the lower cover 26*a*, a pair of side covers 26*c* and 26*d* movable in the direction of width of the strip 4 along outer edges of the lower and upper covers 26*a* and 26*b*, cylinders 26*e* for vertically moving the upper cover 26*b* and cylinders 26*f* and 26*g* for moving the side covers 26*c* and 26*d* in the direction of width of the strip 4. An area of the opening defined by the upper edge of the lower cover 26*a*, the lower edge of the upper cover 26*b* and the side edges of the side covers 26*c* and 26*d* may be adjusted, depending upon cross-sectional profile of the strip 4, by applying fluid pressure to the cylinders 26*e*, 26*f* and 26*g*.

Reference numerals 27*a* and 27*b* denote nozzle groups which are arranged in the downstream chamber 24 between the first pinch rolls 17*a* and 17*b* and the shutter 26 so as to face the lower and upper surfaces of the strip 4, respectively.

Connected to the nozzle groups 27*a* and 27*b* are downstream ends, in the direction of passage of fluid, of supply pipes 33*a* and 33*b* having flow control valves 32*a* and 32*b* and downstream ends, in the direction of passage of fluid, of supply pipes 35*a* and 35*b* having flow control valves 34*a* and 34*b*, respectively.

Reference numeral 36 denotes a gas supply source which comprises nitrogen gas cylinders 36*a*–36*c* filled with nitrogen or non-oxidising gas and a hydrogen gas cylinder 36*d* filled with hydrogen or reducing gas.

Connected to the gas supply source 36 are upstream ends, in the direction of passage of fluid, of the above-mentioned supply pipes 29*a*, 31*a* and 33*a* via a supply pipe 37*a* as well as upstream ends, in the direction of passage of fluid, of the supply pipes 29*b*, 31*b* and 33*b* via a supply pipe 37*b*. When opening degrees of the valves 38*a*–38*c* and 38*d* of the cylinders 36*a*–36*c* and 36*d* and the valves 28*a*, 28*b*, 30*a*, 30*b*, 32*a* and 32*b* of the pipes 29*a*, 29*b*, 31*a*, 31*b*, 33*a* and 33*b* are adjusted properly, a gas mixture flow of nitrogen with hydrogen is injected through the nozzle groups 22*a* , 22*b*, 23*a*, 23*b*, 27*a* and 27*b*.

Reference numeral 41 denotes a coolant supply source which comprises a coolant tank 41*a* for storing a coolant 42 and a pump 41*b* with its suction port communicated with the tank 41*a* and with its discharge port communicated with upstream ends, in the direction of passage of fluid, of the above-mentioned supply pipes 35*a* and 35*b*. When the pump 41*b* is operated and opening degrees of the valves 34*a* and 34*b* of the pipes 35*a* and 35*b* are adjusted properly, the coolant 42 is injected through the nozzle groups 27*a* and 27*b*.

The coolant 42 may comprise methyl alcohol or other quenching medium with very low oxidising property, water, a mixture of methyl alcohol or other quenching medium which is liquid at room temperature.

The inventors have surprisingly found that despite oxidation from disassociation of the coolant and/or entrainment of oxygen therefrom, scale thickness of no more than 0.5 microns can be achieved by the present invention.

Reference numeral 43 denotes a waste liquid processor which comprises a waste liquid tank 43*a* which has an inlet communicated with downstream ends, in the direction of passage of fluid, of the above-mentioned discharge pipes 39 and 40 and which stores a waste liquid 44 such as condensed water generated in the upstream and downstream chambers 19 and 24, and waste coolant and a processor 43*b* for processing the waste liquid 44 from the tank 43*a*.

Next, mode of operation of the twin roll continuous caster shown in FIGS. 1 and 2 will be described.

When the strip 4 is to be continuously cast by the casting rolls 1*a* and 1*b*, prior to the casting of the strip 4, opening degrees of the valves 38*a*–38*c* and 38*d* of the cylinders 36*a*–36*c* and 36*d* and of the valves 28*a*, 28*b*, 30*a*, 30*b*, 31*b*, 33*a* and 33*b* of the pipes 29*a*, 29*b*, 31*a*, 31*b*, 33*a* and 33*b* are properly adjusted to inject a gas mixture flow of nitrogen as principal component with hydrogen through the nozzle groups 22*a* , 22*b*, 23*a*, 23*b*, 27*a* and 27*b*, thereby establishing non-oxidising gas atmosphere in the upstream and downstream chambers 19 and 24.

In this case, the upper cover 26*b* of the shutter 26 is lowered to contact the lower cover 26*a*, thereby closing the end of the downstream chamber 24 facing to the second pinch rolls 18*a* and 18*b* and preventing the gas mixture from flowing out of the downstream chamber 24.

The opening degrees of the valves 38*a*–38*d* are set such that hydrogen is contained by less than 4% in the gas mixture to prevent explosion of the gas mixture which is filled in the upstream and downstream chambers 19 and 24.

When the non-oxidising gas atmosphere is established in the upstream and downstream chambers 19 and 24, the nozzle groups 22*a* and 22*b* in the upstream chamber 19 are moved to their inoperative positions and the table 15 is pivoted into its guiding position.

The upper cover 26*b* is moved up with respect to the lower cover 26*a* and the gap between the side covers 26*c* and 26*d* is adjusted so that the strip 4 to be cast can pass through the shutter 26 with minimum spacing.

In this case, the opening degrees of the valves 28*a*, 28*b*, 30*a*, 30*b*, 33*a* and 33*b* are adjusted such that internal pressures in the upstream and downstream chambers 19 and 24 are slightly higher than the atmospheric pressure. Thus, even when the shutter 26 is opened, external air does not flow into the downstream chamber 24 and the non-oxidising gas atmosphere in the upstream and downstream chambers 19 and 24 remains intact.

When the non-oxidising gas atmosphere is established in the upstream and downstream chambers 19 and 24, molten metal is supplied to the tundish 3 to thereby form the molten metal pool 2 and the rolls 1*a* and 1*b*, 16*a* and 16*b*, 17*a* and 17*b* and 18*a* and 18*b* are rotated to cast the strip 4.

The strip 4 as delivered out by the casting rolls 1*a* and 1*b* is horizontally guided by the table 15 and pinched by the catch rolls 16*a* and 16*b* to be passed through the nozzle groups 23*a* and 23*b*. Then, the strip 4 is pinched by the first pinch rolls 17*a* and 17*b* to be passed through the nozzle groups 27*a* and 27*b*.

When the forward end of the strip 4 is passed through the first pinch rolls 17*a* and 17*b*, the table 15 is pivoted to its inoperative position and the nozzle groups 22*a* and 22*b* are moved to their operative positions so that the nozzle groups 22*a* and 22*b* are faced to one and the other surfaces (the lower and upper surfaces) of the strip 4, respectively.

Then, the pump 41*b* is operated and the opening degrees of the valves 34*a* and 34*b* are adjusted properly to inject the coolant 42 through the nozzle groups 27*a* and 27*b* in addition to the gas mixture flow of nitrogen with hydrogen.

More specifically, in the twin roll continuous caster shown in FIGS. 1 and 2, when the strip 4 is passed through the non-oxidising atmosphere in the upstream and downstream chambers 19 and 24, generation of scales on the surfaces of the strip 4 is effectively suppressed by the gas mixture having nitrogen as principal component and is injected through the nozzle groups 22*a* , 22*b*, 23*a*, 23*b*, 27*a* and 27*b* to the strip 4, and oxidising component of the strip 4 is reduced by the hydrogen gas contained in the gas mixture.

Further, in the downstream chamber 24, the coolant 42 such as methyl alcohol is injected through the nozzle groups 27*a* and 27*b* to the strip 4 to thereby decrease the temperature of the strip 4.

In this case, the temperature of the strip 4 is sensed by non-contact type temperature sensor means (not shown) provided in the downstream chamber 24 and the quantity of coolant injected through the nozzle groups 27*a* and 27*b* is adjusted to lower the temperature of the strip 4 to about 300° C.

Therefore, the strip 4 with minimal or no scale (scale thickness of no more than 0.5 microns) generated thereon is delivered out of the downstream chamber 24 through the nozzle groups 27*a* and 27*b*. After pinched by the second pinch rolls 18*a* and 18*b*, the strip 4 is coiled up by the coiler 8.

As described above, in the twin roll continuous caster shown in FIGS. 1 and 2, the travelling path of the strip from the casting rolls 1*a* and 1*b* to the first pinch rolls 17*a* and 17*b* is enclosed by the upstream chamber 19, the travelling path of the strip 4 from the first pinch rolls 17*a* and 17*b* to a position before the second pinch rolls 18*a* and 18*b* is enclosed by the downstream chamber 24, and non-oxidising gas atmosphere is established in the upstream and downstream chambers 19 and 24 by introducing the gas mixture of nitrogen as principal component with hydrogen. As a result, minimal or no scale (scale thickness of no more than 0.5 microns) is generated on the surfaces of the strip 4.

Moreover, because of the coiler 8 being arranged outside the downstream chamber 24, there is no need of opening the upstream and downstream chambers 19 and 24 to the atmospheric air when the coiled strip 4 is transported out of the system, and wasteful consumption of nitrogen and hydrogen gases is avoided.

Further, because of the strip 4 being cooled down to about 300° C. using coolant 42 such as methyl alcohol, mechanical strength of the strip 4 can be enhanced and scale thickness held to no more than 0.5 microns.

Figure 3:
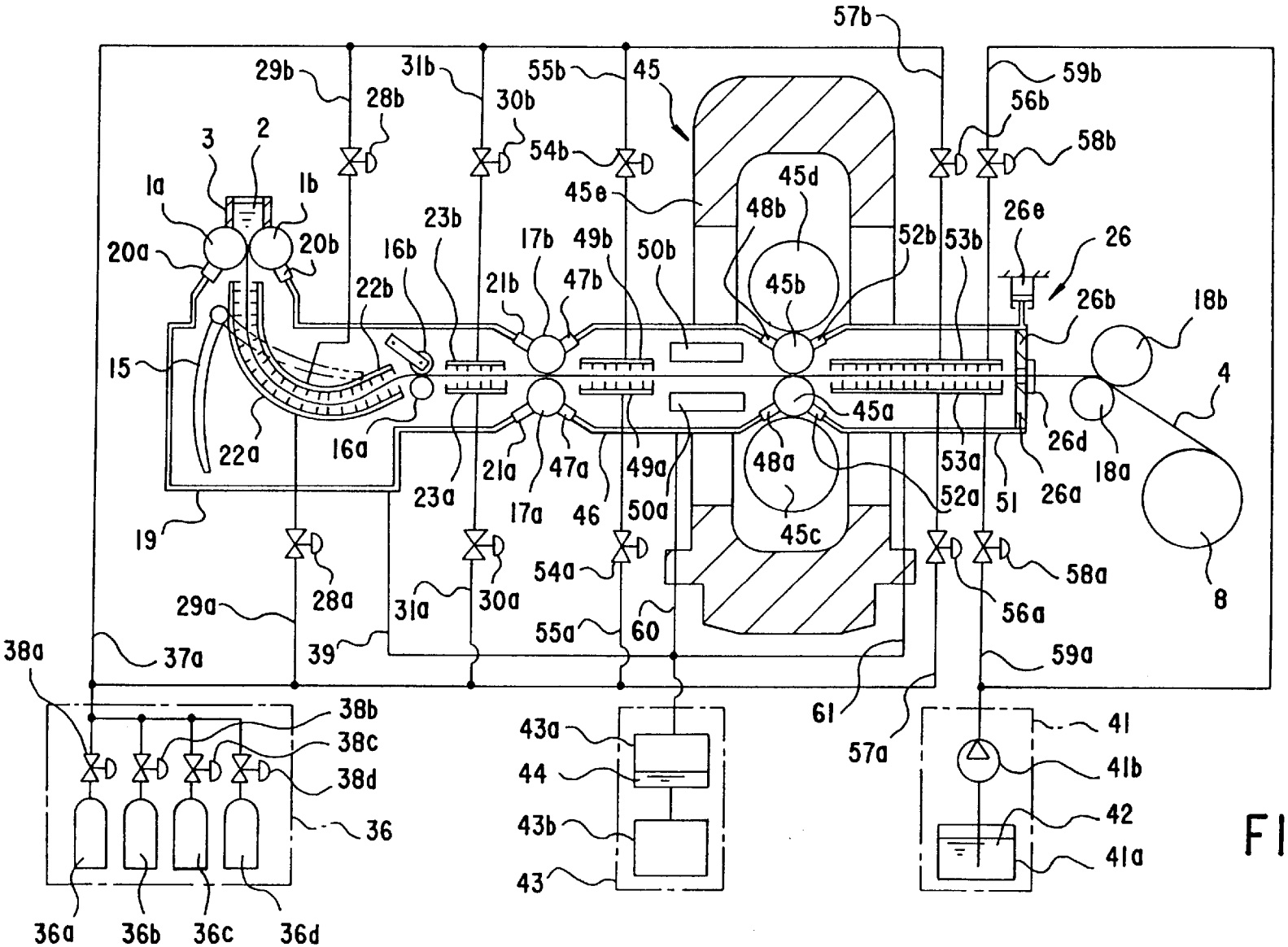
FIG. 3 is a schematic view of a second embodiment of the twin roll continuous caster according to the present invention.

FIG. 3 shows a second embodiment of the twin roll continuous caster of the present invention. The same components as in FIGS. 1 and 2 are referred to by the same reference numerals.

Reference numeral 45 denotes a rolling mill which is arranged between the first pinch rolls 17*a* and 17*b* and the second pinch rolls 18*a* and 18*b*.

The rolling mill 45 comprises a pair of work rolls 45*a* and 45*b* rotatably supported on a housing 45*e* for pinching the strip 4 in the direction of thickness of the strip 4 and a pair of backup rolls 45*c* and 45*d* rotatably supported on the housing 45*e* for rolling the strip 4 through the work rolls 45*a* and 45*b*.

Reference numeral 46 denotes an intermediate chamber which is designed to enclose the travelling path of the strip from the first pinch rolls 17*a* and 17*b* to the work rolls 45*a* and 45*b*.

The intermediate chamber 46 is provided with a non-contact type temperature sensor means (not shown) such as radiation thermometer for sensing the temperature of the strip 4 by converging and converting infrared energy from the surfaces of the strip 4 into electric signal.

Connected to a bottom of the intermediate chamber 46 is an upstream end, in the direction of passage of fluid, of a discharge pipe 60.

Reference numerals 47*a* and 47*b* denotes seal members which are fixed to an end of the intermediate chamber 46 facing to the first pinch rolls 17*a* and 17*b* so as to airtightly contact outer peripheries of the first pinch rolls 17*a* and 17*b*.

Reference numerals 48*a* and 48*b* denote seal members which are fixed to the other end of the intermediate chamber 49 facing to the work rolls 45*a* and 45*b* so as to airtightly contact outer peripheries of the work rolls 45*a* and 45*b*.

These seal members 47*a*, 47*b*, 48*a* and 48*b* may be labyrinth seals or wire seals made of numerous metal wires.

Reference numerals 49*a* and 49*b* denote nozzle groups which are arranged in the intermediate chamber 46 between the first pinch rolls 17*a* and 17*b* and the work rolls 45*a* and 45*b* so as to face the lower and upper surfaces of the strip 4, respectively.

Connected to the nozzle groups 49*a* and 49*b* are downstream ends, in the direction of passage of fluid, of supply pipes 55*a* and 55*b* having flow control valves 54*a* and 54*b*, respectively.

Reference numerals 50*a* and 50*b* denote heaters which are arranged in the intermediate chamber 46 between the nozzle groups 49*a* and 49*b* and the work rolls 45*a* and 45*b* so as to face the lower and upper surfaces of the strip 4, respectively.

Reference numeral 51 denotes a downstream chamber which is designed to enclose the travelling path of the strip from the work rolls 45*a* and 45*b* to a position before the second pinch rolls 18*a* and 18*b*.

The downstream chamber 51 is provided with a non-contact type temperature sensor means (not shown) such as radiation thermometer for sensing the temperature of the strip 4 by converging and converting infrared energy emitted from the surfaces of the strip 4 into electric signal.

Connected to a bottom of the downstream chamber 51 is an upstream end, in the direction of passage of fluid, of a discharge pipe 61.

Reference numerals 52*a* and 52*b* denote seal members which are fixed to an end of the downstream chamber 51 facing to the work rolls 45*a* and 45*b* so as to airtightly contact the outer peripheries of the work rolls 45*a* and 45*b*.

These seal members 52*a* and 52*b* may be labyrinth seals or wire seals made of numerous metal wires.

Arranged on the end of the downstream chamber 51 facing to the second pinch rolls 18*a* and 18*b* is a shutter 26 having the same structure as the one shown in FIG. 2 so as to pass the strip 4.

Reference numerals 53*a* and 53*b* denote nozzle groups which are arranged in the downstream chamber 51 between the work rolls 45*a* and 45*b* and the shutter 26 so as to face lower and upper surfaces of the strip 4, respectively.

Connected to the nozzle groups 53*a* and 53*b* are downstream ends, in the direction of passage of fluid, of supply pipes 57*a* and 57*b* having flow control valves 56*a* and 56*b* and downstream ends, in the direction of passage of fluid, of the supply pipes 59*a* and 59*b* having flow control valves 58*a* and 58*b*, respectively.

Upstream ends, in the direction of passage of fluid, of the above-mentioned supply pipes 55*a* and 57*a* are connected together with the upstream ends of the supply pipes 29*a* and 31*a* to the gas supply source 36 via the supply pipe 37*a*. Upstream ends, in the direction of passage of fluid, of the supply pipes 55*b* and 57*b* are connected together with the upstream ends of the supply pipes 29*b* and 31*b* to the gas supply source 36 via the supply pipe 37*b*. When opening degrees of the valves 38*a*–38*d*, 28*a*, 28*b*, 30*a*, 30*b*, 32*a* and 32*b* are properly adjusted, a gas mixture flow of nitrogen with hydrogen is injected through the nozzle groups 22*a* , 22*b*, 23*a*, 23*b*, 49*a*, 49*b*, 53*a* and 53*b*.

Upstream ends, in the direction of passage of fluid, of the above-mentioned supply pipes 59*a* and 59*b* are communicated with the discharge port of the pump 41*b*. When the pump 41*b* is operated and opening degrees of the valves 58*a* and 58*b* are properly adjusted, the coolant 42 is injected through the nozzle groups 53*a* and 53*b*.

Further, downstream ends, in the direction of passage of fluid, of the discharge pipes 60 and 61 are communicated, together with the downstream ends of the discharge pipes 39 and 40, with the inlet of the waste liquid tank 43*a* so that waste liquid such as condensed water generated in the upstream, intermediate and downstream chambers 19, 46 and 51 and waste coolant is delivered through the tank 43*a* to the processor 43*b* and is processed.

Next, mode of operation of the twin roll continuous caster shown in FIG. 3 will be described.

When the strip 4 is to be continuously cast by the casting rolls 1*a* and 1*b*, prior to the casting of the strip 4, opening degrees of the valves 38*a*–38*d*, 28*a*, 28*b*, 30*a*, 30*b*, 54*a*, 54*b*, 56*a* and 56*b* are properly adjusted to inject a gas mixture flow of nitrogen as principal component with hydrogen through the nozzle groups 22*a* , 22*b*, 23*a*, 23*b*, 49*a*, 49*b*, 53*a* and 53*b*, thereby establishing non-oxidising gas atmosphere in the upstream, intermediate and downstream chambers 19, 46 and 51.

In this case, the shutter 26 is used to prevent the gas mixture from flowing out of the downstream chamber 51.

Moreover, the opening degrees of the valves 38*a*–38*d* are set such that hydrogen is contained by less than 4% in the gas mixture to prevent explosion of the gas mixture, which is filled in the upstream, intermediate and downstream chambers 19, 46 and 51.

When non-oxidising gas atmosphere is established in the upstream, intermediate and downstream chambers 19, 46 and 51, the nozzle groups 22*a* and 22*b* are moved to their inoperative positions and the table 15 is pivoted to its guiding position. Then, the shutter 26 is opened so that the strip 4 can be passed through the shutter 26 with minimum spacing.

When non-oxidising gas atmosphere is established in the upstream, intermediate and downstream chambers 19, 46 and 51, molten metal is supplied to the tundish 3 to form the molten metal pool 2 and the rolls 1*a* and 1*b*, 16*a* and 16*b*, 17*a* and 17*b*, 45*a* and 45*b* and 18*a* and 18*b* are rotated to cast the strip.

The strip 4 delivered out by the casting rolls la and 1*b* is horizontally guided by the table 15, and after being passed through the catch rolls 16*a* and 16*b*, through the nozzle groups 23*a* and 23*b*, through the first pinch rolls 17*a* and 17*b*, through the nozzle groups 49*a* and 49*b* and through the heaters 50*a* and 50*b*, it is rolled by the work rolls 45*a* and 45*b* of the rolling mill 45 to such thickness as not attainable by the casting rolls 1*a* and 1*b* alone.

When the forward end of the strip 4 is passed through the first pinch rolls 17*a* and 17*b*, the table 15 is pivoted to its inoperative position and the nozzle groups 22*a* and 22*b* are moved to their operative positions.

The pump 41*b* is operated and openings of the flow control valves 58*a* and 58*b* are properly adjusted to inject the coolant 42 through the nozzle groups 27*a* and 27*b* in addition to the gas mixture flow of nitrogen with hydrogen.

More specifically, in the twin roll continuous caster shown in FIG. 3, when the strip 4 is passed through the non-oxidising atmosphere in the upstream, intermediate and downstream chambers 19, 46 and 51, generation of scales on the surfaces of the strip 4 is effectively suppressed by the gas mixture containing nitrogen as principal component and injected through the nozzle groups 22*a*, 22*b*, 23*a*, 23*b*, 49*a*, 49*b*, 53*a* and 53*b* to the strip 4. Oxidising component in the strip 4 is reduced by hydrogen gas in the gas mixture.

Further, in the downstream chamber 51, the coolant 42 such as methyl alcohol is injected through the nozzle groups 53*a* and 53*b* to the strip 4 to thereby decrease the temperature of the strip 4.

In this case, the temperature of the strip 4 is detected by the non-contact type temperature sensor means (not shown) provided in the downstream chamber 51, and the quantity of coolant injected through the nozzle groups 53*a* and 53*b* is adjusted to make the temperature of the strip 4 to about 300° C.

Therefore, the strip, which has been rolled to such thickness as not attainable by the casting rolls 1*a* and 1*b* alone and has minimal or no scale (scale thickness of no more than 0.5 microns) generated thereon, is delivered out of the downstream chamber 24 through the nozzle groups 53*a* and 53*b*. After being pinched by the second pinch rolls 18*a* and 18*b*, the strip 4 is coiled up by the coiler 8.

In rolling the strip 4, the temperature of the strip before the rolling mill 45 is sensed by the non-contact temperature sensor means (not shown) provided in the intermediate chamber 46. If the sensed temperature of the strip 4 is lower than about 900° to 1000° C., the strip 4 is heated up by the heaters 50*a* and 50*b* so that the strip 4 can be rolled under proper conditions.

As described above, in the twin roll continuous caster shown in FIG. 3, the travelling path of the strip from the casting rolls 1*a* and 1*b* to the first pinch rolls 17*a* and 17*b* is enclosed by the upstream chamber 19. The travelling path of the strip from the first pinch rolls 17*a* and 17*b* to the work rolls 45*a* and 45*b* of the rolling mill 45 is enclosed by the intermediate chamber 46. The travelling path of the strip 4 from the work rolls 45*a* and 45*b* to a position before the second pinch rolls 18*a* and 18*b* is enclosed by the downstream chamber 51. Moreover, non-oxidising gas atmosphere is established in the upstream, intermediate and downstream chambers 19, 46 and 51 by the gas mixture of nitrogen as principal component with hydrogen. As a result, no scale is generated on the surfaces of the strip 4.

Since the coiler 8 is arranged outside the downstream chamber 51, there is no need of opening the upstream, intermediate and downstream chambers 19, 46 and 51 to the atmospheric air when the coiled strip is transported out of the system. This prevents wasteful consumption of nitrogen and hydrogen gases.

Further, the strip 4 is rolled by the work rolls 45*a* and 45*b* of the rolling mill 45 to such thickness as not attainable by the casting rolls 1*a* and 1*b* alone and is cooled down to about 300° C. As a result, mechanical strength of the strip 4 can be enhanced and scale thickness held to no more than 0.5 micron.

As described above, a twin roll continuous caster according to the present invention can exhibit various excellent effects as described below:

(1) In accordance with the invention, the coiler is arranged outside the downstream chamber and seal means is provided on the downstream chamber. Therefore, the coiled strip can be transported out of system without opening the upstream and downstream chambers to the atmospheric air and wasteful consumption of the non-oxidising reducing gases is reduced. Further the use of multiple sealed chambers enhances the reduction of gas loss.

(2) The travelling path of the strip from the casting rolls to the pinch rolls is enclosed by the upstream chamber and the travelling path of the strip from the pinch rolls to a position before the coiler is enclosed by the downstream chamber. Non-oxidising gas atmosphere is established in the upstream and downstream chambers by the non-oxidising and the reducing gases and a quenching medium is provided in the downstream chamber, so that the strip is cooled to no more than 300° C. Thus, minimal or no scale (scale thickness of no more than 0.5 microns) is generated on the surfaces of the strip and the production yield of the strip is increased. Also, no pickling process line is needed, which contributes to reduction of installation and production costs.

(3) In embodiments of the invention provided with a rolling mill, the travelling path of the strip from the casting rolls to the pinch rolls is enclosed by the upstream chamber, the travelling path of the strip from the pinch rolls to the works rolls of the rolling mill is enclosed by the intermediate chamber and the travelling path of the strip from the work rolls to a position before the coiler is enclosed by the downstream chamber. Non-oxidising gas atmosphere is established in the upstream, intermediate and downstream chambers by the non-oxidising and reducing gases and a quenching medium is provided in the intermediate and/or downstream chambers so that the strip is cooled to no more than 300° C. Therefore, minimal or no scale (scale thickness of 0.5 microns or below) is generated on the surfaces of the strip and production yield of the strip is increased. Also, no pickling process line is needed, which contributes to the reduction of installation and production costs.

(4) The rolling mill is arranged between the pinch rolls and the coiler. This makes it possible to roll the strip to such thickness as not attainable by the casting rolls alone, and increases mechanical strength of the strip.

(5) Additionally, heaters are provided between the pinch rolls and the rolling mill. Therefore, the strip can be adjusted to such temperature as suitable for rolling process.

(6) Further the strip to be delivered out of the downstream chamber is cooled down by the coolant injected through the nozzle groups. Therefore, mechanical strength of the strip is increased.

The provision of quenching means in the downstream chamber, or in any chamber other than the upstream chamber, reduces or substantially eliminates the risk of problems with vaporisation and condensation.

It is needless to say that the present invention is not limited to the above embodiments and that various changes and modifications may be made without departing from the spirit and the scope of the invention.

We claim:

1. Apparatus for casting metal strip comprising:

a pair of generally horizontal casting rolls forming a nip between them;

metal delivery means for delivering molten metal into the nip between the casting rolls to form a casting pool of molten metal supported on the rolls;

means for chilling the casting rolls;

means for rotating the casting rolls in mutually opposite directions to produce a cast strip delivered downwardly from the nip;

strip guide means guiding the strip delivered downwardly from the nip through a travelling path which takes it away from the nip towards a coiler;

a hot rolling mill, disposed along said travelling path to receive the cast strip and to roll that strip in line with the strip caster; and an enclosure to confirm the strip throughout said travelling path which enclosure comprises an upstream chamber adapted to enclose the strip from its formation at the nip and one or more other chambers, each chamber having means for providing a controlled atmosphere to control the formation of scale on the strip during operation of the apparatus wherein at least one of the one or more other chambers is provided with quenching means comprising a quenching medium which is liquid at room temperature for quenching the strip passing therethrough, and wherein the rolling mill is disposed between chambers.

2. Apparatus as claimed in claim 1 further comprising pinch rolls for pinching a strip continuously cast by the pair of casting rolls, a rolling mill with a pair of work rolls for rolling the strip delivered from said pinch rolls, a coiler being adapted to coil the strip delivered from the rolling mill, the enclosure comprising the upstream chamber for enclosing a travelling path of the strip from the casting rolls to the pinch rolls, said upstream chamber having seal members for airtightly contacting outer peripheries of the casting and pinch rolls, and two other chambers being an intermediate chamber for enclosing a travelling path of the strip from the pinch rolls to the work rolls, said intermediate chamber having seal members for airtightly contacting outer peripheries of the pinch and work rolls and a downstream chamber for enclosing a travelling path of the strip from the work rolls to a position before the coiler, said downstream chamber having seal members for airtightly contracting outer peripheries of the work rolls and seal means on an end of the downstream chamber closer to the coiler adapted to pass the strip therethrough, a gas supply source for supplying non-oxidising and reducing gases to the upstream, intermediate and downstream chambers and quenching means for quenching the strip in the downstream chamber and whereby the strip is coiled.

3. Apparatus as claimed in claim 1, wherein the quenching medium is one of methyl alcohol, water and a mixture of methyl alcohol and water.

4. Apparatus as claimed in claim 1, further comprising heating means disposed ahead of the rolling mill to adjust the temperature of the strip before it enters the rolling mill.

5. Apparatus as claimed in claim 1 further comprising means to supply non-oxidising gas to one or more of the chambers.

6. Apparatus as claimed in claim 1 further comprising means to supply reducing gas to one or more of the chambers.

7. Apparatus as claimed in claim 1 further comprising means to supply quenching medium to one or more of the other chambers.

8. Apparatus as claimed in claim 1 further comprising means for collecting and means for processing waste quenching medium for recycling as quenching medium.

9. Apparatus according to claim 1, wherein nozzle groups are arranged in each of the chambers to face the strip, said nozzle groups being, connected to a gas supply source.

10. Apparatus according to claim 2, wherein heaters are arranged between the pinch rolls and the work rolls to face the strip.

11. Apparatus according to claim 1, wherein the quenching means comprises nozzle groups in the downstream chamber adapted to face the strip and quenching medium supply source for supplying quenching medium thereto.

12. Apparatus according to claim 9, wherein the nozzle groups in the downstream chamber are additionally connected to quenching medium supply source for supplying quenching medium.

13. Apparatus according to claim 1, wherein non-oxidising and reducing gases are supplied into the chambers.

14. Apparatus according to claim 2, wherein the temperature of the strip is adjusted to a temperature suitable for rolling by heaters arranged between the pinch rolls and the rolling mill.

15. Apparatus according to claim 2, wherein the seal means is in the form of a shutter.

* * * * *